United States Patent [19]

Dragone

[11] Patent Number: 4,786,910

[45] Date of Patent: Nov. 22, 1988

[54] SINGLE REFLECTOR MULTIBEAM ANTENNA ARRANGEMENT WITH A WIDE FIELD OF VIEW

[75] Inventor: Corrado Dragone, Little Silver, N.J.

[73] Assignee: American Telephone and Telegraph Company, AT&T Bell Laboratories, Murray Hill, N.J.

[21] Appl. No.: 117,109

[22] Filed: Nov. 5, 1987

[51] Int. Cl.[4] ..... H01Q 19/14

[52] U.S. Cl. ..... 343/753; 343/781 P; 343/781 R

[58] Field of Search ..... 343/753, 781 P, 781 R, 343/909

[56] References Cited

U.S. PATENT DOCUMENTS

| | | | |
|---|---|---|---|
| 3,146,451 | 8/1964 | Sternberg | 343/753 |
| 3,886,561 | 5/1975 | Beyer | 343/910 |
| 3,922,682 | 11/1975 | Hyde | 343/761 |
| 3,995,275 | 11/1976 | Betsudan et al. | 343/781 |
| 4,224,626 | 9/1980 | Sternberg | 343/911 |
| 4,343,002 | 8/1982 | Lutt | 343/753 |
| 4,355,314 | 11/1982 | Ohm | 343/779 |
| 4,435,714 | 3/1984 | Lutt | 343/781 P |

OTHER PUBLICATIONS

Turrin, *Bell System Technical Jrnl.*, vol. 54, No. 6, Jul.-Aug. 1975, pp. 1011-1026.

*Primary Examiner*—William L. Sikes
*Assistant Examiner*—Hoanganh Le
*Attorney, Agent, or Firm*—Erwin W. Pfeifle

[57] ABSTRACT

The present invention relates to an antenna comprising a plurality of feeds, and either a single reflector or a single lens wherein the reflector or lens includes a predetermined curved major surface that produces a maximum field of view in a first one of two principal planes of the antenna. The major curved surface is designed to produce a first and a second "stigmatic" focal point, which are spaced apart by a predetermined amount on either side of an axis normal to the center of the reflector or lens in the first principal plane, such that the coefficient of astigmatism is at a maximum predetermined tolerable amount at the center and at the opposite edges of the maximum field of view to produce a peanut-shaped area where the coefficient of astigmatism is within tolerable limits. For the lens design, the plurality of feeds can be disposed within the peanut-shaped area, while for the reflector design the feeds should preferably be disposed within the peanut-shaped area where no antenna aperture blockage occurs.

4 Claims, 5 Drawing Sheets

SINGLE REFLECTOR MULTIBEAM ANTENNA ARRANGEMENT WITH A WIDE FIELD OF VIEW

TECHNICAL FIELD

The present invention relates to a multibeam antenna arrangement with a wide field of view which can be used by itself, or in N multiples thereof to cover up to a 360 degree field of view in a metropolitan area.

2. DESCRIPTION OF THE PRIOR ART

In many applications, reflectors or lenses used for antennas will generate aberrations in a wavefront reflected or refracted therefrom. This is especially true in a multibeam antenna system when feeds are disposed away from the antenna focus or where the main reflector is offset. Antenna systems, however, have been devised to correct for aberrations as, for example, astigmatism or coma.

In reflector antenna systems, an antenna arrangement for correcting for the aberration of coma is disclosed, for example, in U.S. Pat. No. 4,355,314 issued to E. A. Ohm on Oct. 19, 1982 wherein a wide field-of-view antenna arrangement employs a subreflector which is positioned relative to a main reflector such that the tangential and sagittal focal regions lie behind the subreflector of a Cassegrainian arrangement, or alternatively in front of the subreflector of a Gregorian arrangement. Another reflector antenna arrangement is disclosed in U.S. Pat. No. 3,922,682 issued to G. Hyde on Nov. 25, 1975, wherein aberration correcting subreflectors are provided for single or multibeam toroidal reflector antennas to achieve a point focus in a system which, without the subreflector, does not focus at a point. Still other antenna arrangements provide correction for astigmatism as disclosed, for example in U.S. Pat. No. 4,145,695 issued to M. J. Gans on Mar. 20, 1979. Each of these aberration correcting antennas require subreflectors which are designed and/or positioned for canceling a particular one or more aberrations. Additionally, to obtain a wide field of view in reflector antenna arrangements with minimal blockage, it generally requires that the subreflectors be disposed a sufficient distance away from the main reflector which makes for a large and sometimes unwieldy antenna.

Various lens antenna configurations have also been provided to compensate for such aberrations. In this regard see, for example, U.S. Pat. Nos. 3,146,451 and 4,224,626 issued to R. L. Sternberg on Aug. 25, 1964, and Sept. 23, 1980, respectively. In U.S. Pat. No. 3,146,451, a dielectric lens is axially symmetric and has curves defining the lens surface or zones for focusing microwave energy emanating from a plurality of off-axis focal points on the focal surface into respective collimated beams angularly oriented relative to the lens axis. U.S. Pat. No. 4,224,626 discloses an ellipticized lens with an expanded field of view in one plane for providing balanced astigmatism; the periphery and the two curved surfaces being defined by a system of non-linear partial differential equations. The two opposing curved surfaces of the lens act together to allegedly produce two perfect primary off-axis foci at a finite distance in back of the lens on the focal surface of the lens and two separate perfect conjugate off-axis foci in front of the lens at infinity. Therefore, all aberrations are allegedly compensated for at the perfect off-axis foci by the two curved surface of the lens.

The problem remaining in the prior art is to provide a simple lens or reflector antenna arrangement which has a wide field of view and avoids the need for (1) subreflectors in reflector antenna arrangements or (2) a lens with two curved surfaces.

SUMMARY OF THE INVENTION

The foregoing problem in the prior art has been solved in accordance with the present invention which relates to a multibeam antenna arrangement comprising (1) a plurality of feeds, and (2) either a single reflector, or a single lens, comprising (a) a focal length to diameter (f/D) ratio which is large enough so that the only significant aberration is astigmatism, and (b) one major curved surface arranged for providing a much wider field of view in a first principal plane of the antenna than in a second principal plane orthogonal to the first principal plane. More particularly, the selectively designed curved major surface of the reflector or lens forms a first and a second "stigmatic" focal point in the first principal plane both on a focal surface of the reflector or lens and at separate predetermined equi-distantly spaced points on either side of an axis normal to the center of the reflector or lens. To provide a maximum field of view, the two "stigmatic" foci are separated a distance such that the coefficient of astigmatism is at the maximum tolerable amount at a central point and at the opposite edges of a desired field of view. Such arrangement provides a peanut-shaped or infinity symbol type area on the focal surface wherein the coefficient of astigmatism is equal to or less than the maximum tolerable amount and the area wherein the feeds should be placed.

Other and further aspects of the present invention will become apparent during the course of the following description and by reference to the accompanying drawings.

BRIEF DESCRIPTION OF THE DRAWINGS

Referring now to the drawings in which like numerals represent like parts in the several views.

DETAILED DESCRIPTION

The present invention relates to a single lens or reflector with a curved surface design to produce two "stigmatic" foci, designated hereinafter as $F_1$ and $F_2$, at selected equal distances and at equal angles from an axis normal to the central point of the lens or reflector, which curved surface design and "stigmatic" foci distances are chosen so as to maximize the field of view in the plane containing the feeds providing the best aperture efficiency. Such lens or reflector is hereinafter described for the exemplary purposes of transmitting or receiving electromagnetic energy. It should, however, be understood that the principle of the present invention can also be applied to other uses such as, for example, the transmission of infrared or lightwave energy.

Figure 1:
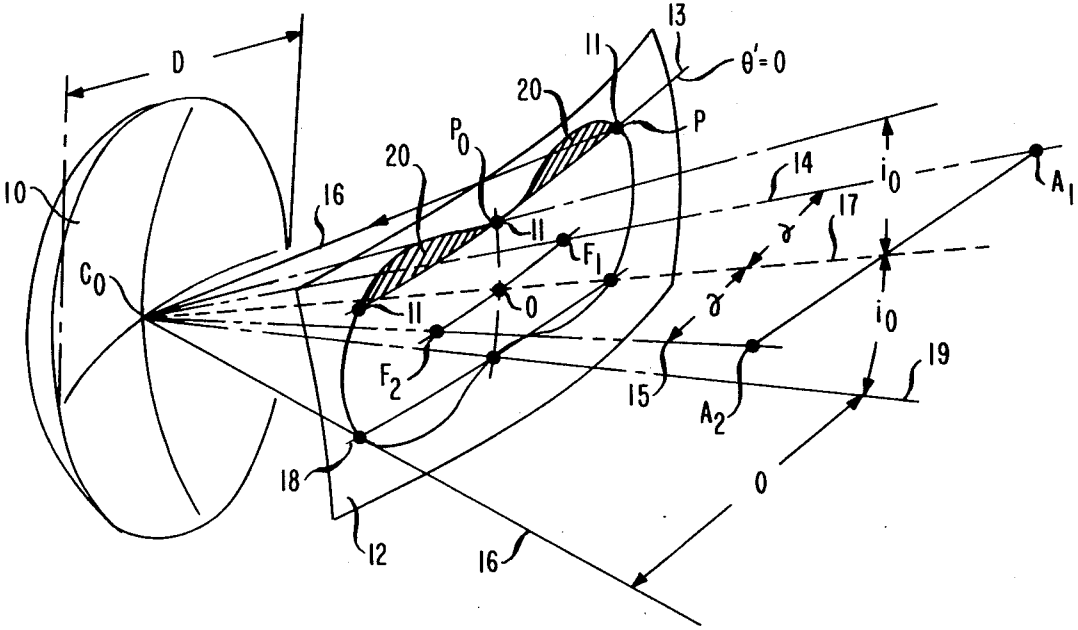
FIG. 1 is a view in perspective of a reflector antenna in accordance with the present invention.

FIG. 1 illustrates a reflector antenna geometry in accordance with the present invention comprising a reflector with a predetermined curved reflecting surface 10 and a diameter D, the entire reflecting surface 10 being efficiently illuminated by each of a set of feeds, or point sources, 11 placed in a focal surface 12 of reflecting surface 10. The feeds 11 are shown as being disposed on a planar curved line 13 of focal surface 12 which is located at the boundary where feeds 11 will not cause aperture blockage, was shown for feed $P_0$ in FIG. 2. For purposes of explanation hereinafter, reflecting surface 10 will be considered to comprise an ellipsoidal shape and a field of view which is wider in, for example, the horizontal plane than in the vertical plane.

The shape of ellipsoidal reflecting surface 10 forms a first and a second focal point, designated $A_1$ and $A_2$, respectively, in FIG. 1 which are disposed along respective lines 14 and 15. Lines 14 and 15 emanate from the center $C_0$ of ellipsoidal reflecting surface 10 on opposite sides of an axis 17 which is normal to central point $C_0$, and at an angle $\gamma$ to axis 17. By definition, a spherical beam radiated from, for example, focus $A_1$, which beam entirely illuminates ellipsoidal reflecting surface 10, will be refocused at focus $A_2$, and vice versa. Focal surface 12, however, is disposed such that when the aperture of a feed 11 is disposed on planar curved line 13, is at an angle $i_0$ from axis 17, the feed 11 will radiates a spherical beam to entirely illuminate ellipsoidal reflecting surface 10 and produce a reflected beam with a substantially planar wavefront for transmission to the far field of the antenna. Also disposed in focal surface are "stigmatic" foci $F_1$ and $F_2$ at the points where lines 14 and 15, respectively intersect focal surface 13. It is to be understood that the curvature of reflecting surface 10 will determine the angle $\gamma$ and the location of foci $A_1$, $A_2$, $F_1$ and $F_2$.

A principal ray 16 from, for example, the feed 11 designated P in FIG. 1 which is reflected from the center $C_0$ of ellipsoidal reflecting surface 10 determines the direction of corresponding beam. Feeds 11 which are disposed along line 13 in focal surface 12, which hereinafter will be considered as corresponding to an angle $\theta'=0$, will transmit beams that will be directed with their principal rays 16 intersecting a line 18 which is equivalent to $\theta'=0$ on the opposite side of the plane normal to central point $C_0$ and including foci $F_1$, $F_2$, $A_1$, $A_2$ and axis 17. It is to be understood that beams with nonzero elevation angles of $\theta'$ are also possible by displacing some of the feeds 11 from the planar curved line 13, but such nonzero elevation angles will produce a loose in aperture efficiency from beams emanating from planar curved line 13. More particularly, feeds 11 placed on planar curved line 13 will keep the angle of incidence, corresponding to $i_0$, as small as possible without aperture blockage. Such result could also occur if feeds 11 where placed along planar curved line 18 instead of planar curved line 13. Aperture blockage or increased offset will, however, reduce aperture efficiency from locations where $\theta'=0$.

Figure 2:
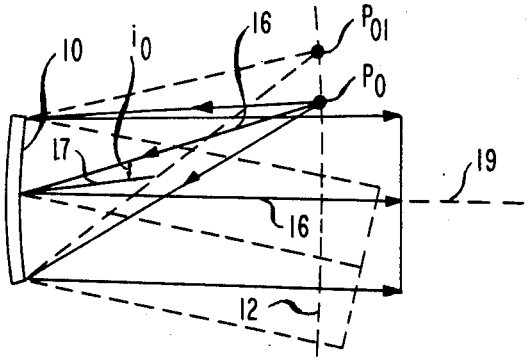
FIG. 2 is a side view of the arrangement of FIG. 1 showing beam directions from various offset feeds.

The direction of each beam in FIGS. 1 and 2 is specified by two angles: (1) the elevation angle $i_0+\theta'$ with respect to the plane through axis 17 and foci $F_1$ and $F_2$, and (2) the angle $\theta$ with respect to the vertical plane through both axis 17 and antenna axis 19. It is desirable to maximize the aperture efficiency for those beams that are directed to stations, or receivers, which are furthest from the present antenna since these station will experience the most signal transmission loss. For these far stations, $\theta'$ is generally small and, since antenna are usually placed at high vantage points, the plane comprising both antenna axis 19 and line 18 should preferably be disposed substantially horizontal to the local terrain or correspond to the general line of sight of the farthest and highest stations. For some other stations, $\theta'$ may be as large as, for example, 10 degrees, but these stations will be close to the present antenna, so that larger aberrations (reducing efficiency by 3 dB or more) can be tolerated. It is for this reason that the feeds 11 are preferably disposed above antenna axis 19, as shown in FIG. 2, rather than below axis 19, since a feed $P_0$, on line 13, will transmit to a far station with maximum aperture efficiency while a feed $P_{01}$ can be disposed to transmit to a close station without antenna aperture blockage but at a reduced aperture efficiency because of increased offset. If the feeds 11 were disposed below axis 17. a corresponding feed $P_0$ on line 18 could still send to the far station with the same aperture efficiency, but a close station would require a corresponding feed $P_{01}$ to be placed in the aperture of the antenna. The lowest possible value that can be chosen for the angle $i_0$ without causing antenna aperture blockage is determined by the ratio D/f between the reflector diameter D and its focal length f.

Figure 3:
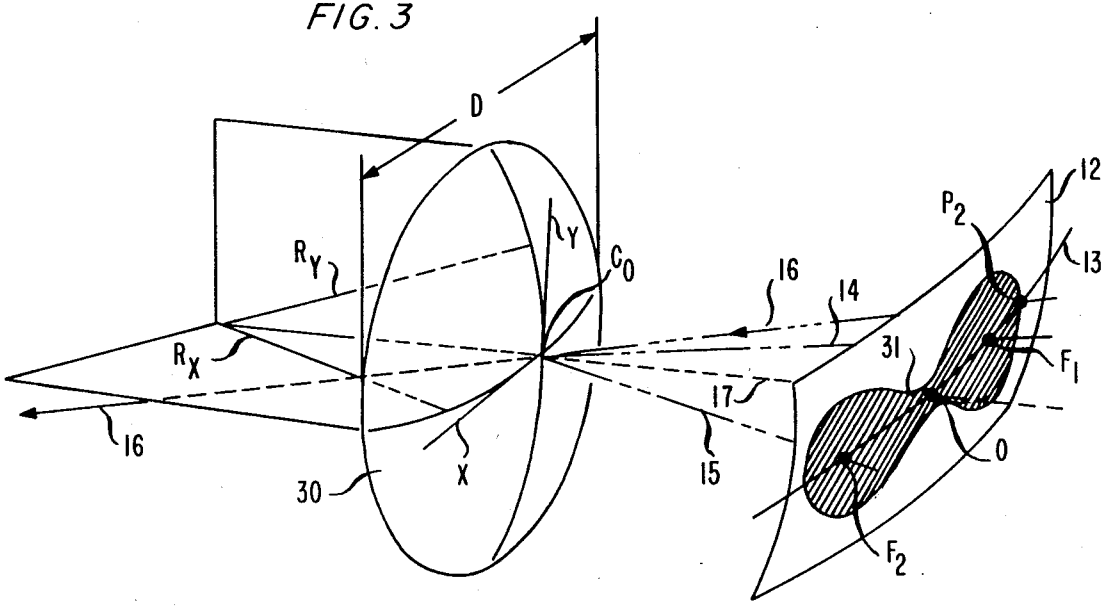
FIG. 3 is a view in perspective of a lens antenna in accordance with the present invention.

The optimum reflecting surface 10 giving the widest possible field of view under conditions described above is not a paraboloid. To determine the optimum reflecting surface 10, let the ratio f/D be chosen large enough so that the only significant aberration is astigmatism. Astigmatism reduces aperture efficiency and, for instance, in order that the less than 1.25 dB, the maximum path length error, $a_2$, caused by astigmatism must be less and $\lambda/4$. Thus, in general, efficient operation is only possible for those feed 11 locatins satisfying $a_2<a$, where "a" is the largest path length error that can be tolerated, and typically "a" approximates $\lambda/4$. For a lens 30 arrangement in accordance with the present invention, the above condition determines the field of view with acceptable aperture efficiency and is shown in FIG. 3 by, for example, the hatched area 31 in focal surface 12. For a reflector surface 10, however, the central region of the field of view in the vicinity of axis 17 cannot be used because of aperture blockage. A suitable region over which feeds 11 can be located without blocking any rays, where $a_2 \leqq a$, is shown by the exemplary hatched area 20 in FIG. 1. Thus, an important difference between FIGS. 1 and 3 is that in the lens 30 arrangement of FIG. 3, the planar curved line 13 corresponding to $\theta'=0$ can pass through the two "stigmatic" foci $F_1$ and $F_2$ while for the reflector surface arrangement of FIG. 1, planar curved line 13 must be displaced from axis 17 by the angle $i_0$.

Figure 4:
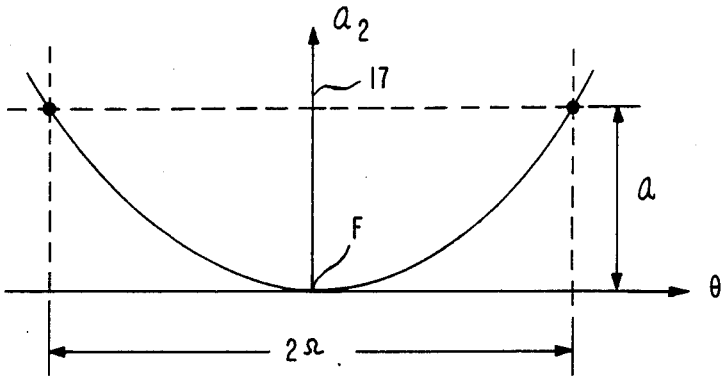
FIG. 4 is a graph of the coefficient of astigmatism for a parabolic lens or reflector.
Figure 5:
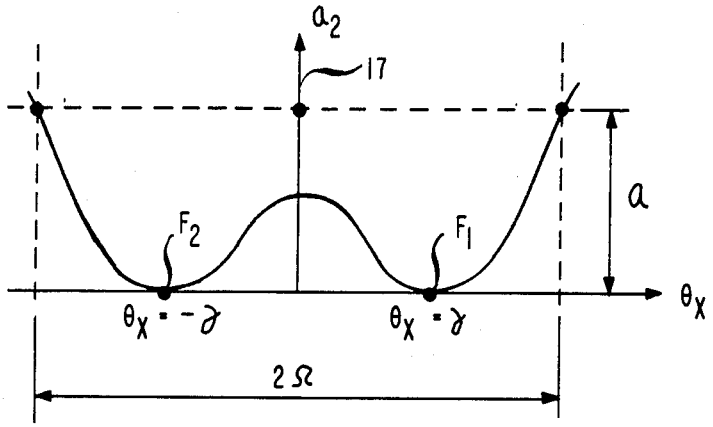
FIG. 5 is a graph of the coefficient of astigmatism as the curvature in the plane of $y=0$ is reduced compared to the curvature in the $x=0$ plane.
Figure 6:
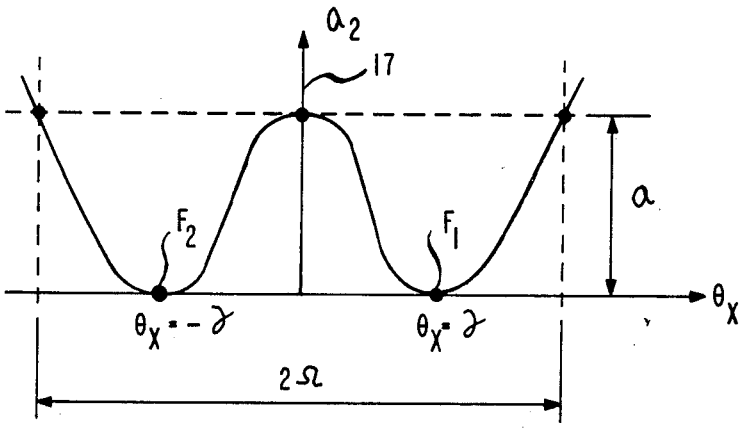
FIG. 6 is a graph of the coefficient of astigmatism for a lens antenna of FIG. 3 where the field of view is maximized.

For a centered lens or reflector surface having rotational symmetry as found, for example with a parabolic lens or reflecting surface, the coefficient of astigmatism, $a_2$, has the behavior shown in FIG. 4. Such coefficient of astigmatism is zero at the focus F on the axis 17 and non-zero for the angle $\theta$ from the axis. The largest value that $\theta$ can have without violating the condition $a_2 > a$ on either side of axis 17 is $\Omega$. In accordance with the present invention, a larger value of $\Omega$ can be obtained by reducing the lens 30, or reflecting surface 10, curvature in the plane corresponding to, for example, $y=0$ with respect to the curvature in the plane corresponding to $x=0$ so as to obtain for $a_2$ the behavior illustrated in FIG. 5. In the principal plane $y=0$, $a_2$ now has an increased value on the axis 17 corresponding to $\theta_x=0$, and has two zeros for $\theta_x=\pm\gamma$. The value of $\gamma$ in FIG. 5 is determined by the two principal curvatures $1/R_x$ and $1/R_y$ in the planes $x=0$ and $y=0$, respectively, which determines the locations in FIG. 5 of the two zeros corresponding to foci $F_1$ and $F_2$. As one reduces the curvature in the plane corresponding to $y=0$, it will be found that both $\Omega$ and $a_2$ at $\theta_x=0$ increase with $\gamma$. In accordance with the present invention, the largest $\Omega$, or field of view, attainable without violating the condition $a_2 < a$ is obtained when $\gamma$ is chosen so that $a_2$ is at the maximum tolerable value at $\theta_x=0$ as shown in FIG. 6. The field of view of a reflecting surface 10 can also be maximized in a similar way.

For $\gamma=0$, corresponding to a centered lens, as might be found for a parabolic lens or reflector, the field of view is a circle. As $\gamma$ increases the field of view transforms from the circular shape into an elliptical shape, then into a peanut shape (as shown in FIGS. 1 and 3), until it achieves the shape corresponding to the symbol for "infinity", $\infty$, where the field of view splits into two separate regions. For the lens arrangement, the widest field of view is obtained by a peanut-shape which approaches, but does not quite attain, the infinity symbol shape as shown in FIG. 3.

Figure 7:
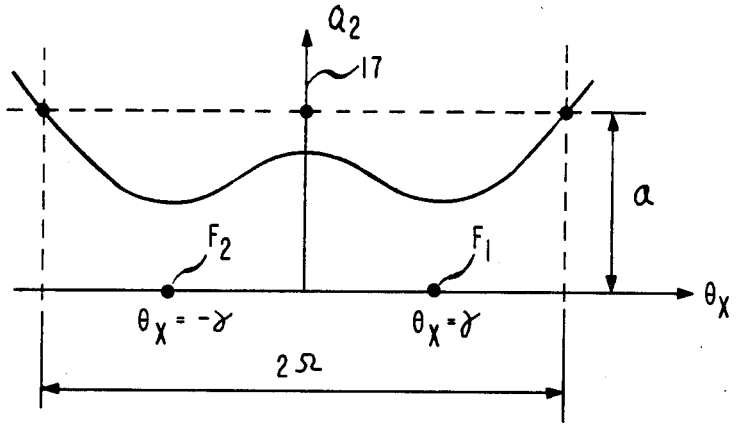
FIG. 7 is a graph of the coefficient of astigmatism for a reflector antenna where the feeds are displaced from the line of the foci to avoid aperture blockage.
Figure 8:
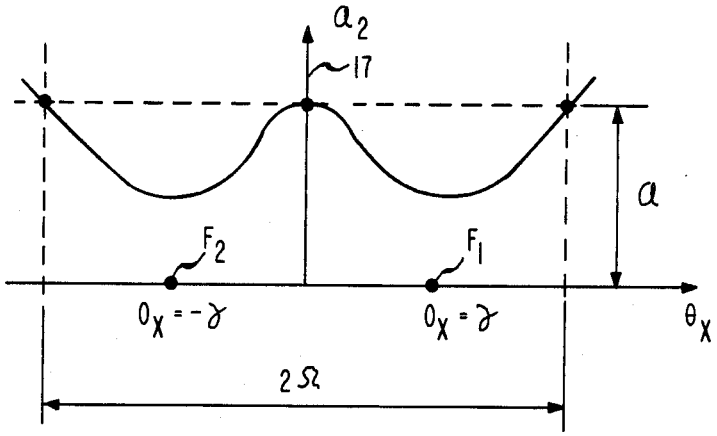
FIG. 8 is a graph of the coefficient of astigmatism for a reflector antenna similar to that of FIG. 7 but where the field of view is maximized.

For the reflector arrangement, however, the line 13 is displaced from the axis 17 or reflecting surface 10 by a nonzero angle $i_0$ required to avoid aperture blockage. Then, for a feed P placed on planar curved line 13 at an angle $\theta_x$ from the central position $P_0$, as shown in FIG. 1, the behavior for $a_2$ becomes that shown in FIG. 7, assuming line 13 is only slightly displaced from axis 17. Since line 13 now does not contain the two foci $F_1$ and $F_2$, the coefficient of astigmatism $a_2$ does not vanish for $\theta_x=\pm\gamma$, but has two minima in the vicinity of these two locations. The largest width $2\Omega$ for the field of view is obtained, also for this arrangement, by choosing for $\gamma$ the largest value allowed by the condition $a_2 < a$. Then the behavior for $a_2$ is obtained as shown in FIG. 8 with $a_2=a$ for the three locations.

For the lens embodiment described hereinbefore, it was assumed that only one of the two major opposing surfaces of the lens was curved and that the other surface is flat, since such arrangement will generally simplify the construction of the lens. However, it is to be understood that the two foci $F_1$ and $F_2$ could not be affected if the flat surface were replaced by a slightly curved surface, providing the opposed curved surface is properly modified by applying to it a deformation opposite to the deformation applied to the flat surface. Thus, for example, the flat surface may be replaced with a cylindrical surface properly chosen so that the other surface becomes a centered surface, with rotational symmetry, which is relatively easy to obtain. Additionally, the flat surface, or the modified flat surface, of the lens can be disposed on the side of the lens which is either towards or away from the feeds 11.

What is claimed is:

1. An antenna for producing a maximum desired field of view in a first one of two orthogonal principal planes, the antenna comprising:

a device including both (A) a major surface which is curved in each of the two orthogonal principal planes to produce a first and a second focal point on a focal surface of the device line the first of the two principal planes, and (B) a focal length diameter (f/D) ratio which is of a magnitude such that the only significant aberration is astigmatism, the first and second focal points being spaced apart on either side of the axis normal to the center of the curved major surface by a predetermined amount such that (1) a coefficient of astigmatism is essentially at a maximum tolerable amount at both a central point and at opposite edges of the field of view of the device in the first principal plane; and (2) a peanut-shaped area is produced (a) wherein the coefficient of astigmatism is equal to or less than the maximum tolerable coefficient of astigmatism, and (b) which is widest along the first principal plane; and a plurality of feeds disposed both on the focal surface of the device and in the peanut-shaped area, each feed including a longitudinal axis which is directed at the device for propagating, in any one of two directions along the longitudinal axis, beams which include (1) a spherical wavefront when propagating between a feed and the device, and (2) a substantially planar wavefront when propagating between the device and a remote location.

2. An antenna according to claim 1 wherein the device is a reflector.

3. An antenna according to claim 2 wherein the plurality of feeds are disposed to avoid aperture blockage of any portion of a substantially planar wavefront.

4. An antenna according to claim 1 wherein the device is a lens.

* * * * *